US008671896B2

(12) United States Patent
Hisaminato et al.

(10) Patent No.: US 8,671,896 B2
(45) Date of Patent: Mar. 18, 2014

(54) VARIABLE COMPRESSION RATIO V-TYPE INTERNAL COMBUSTION ENGINE

(75) Inventors: Naoto Hisaminato, Susono (JP); Manabu Tateno, Shizuoka (JP); Eiichi Kamiyama, Mishima (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 13/499,933

(22) PCT Filed: Nov. 13, 2009

(86) PCT No.: PCT/JP2009/069669

§ 371 (c)(1),
(2), (4) Date: Apr. 3, 2012

(87) PCT Pub. No.: WO2011/058663

PCT Pub. Date: May 19, 2011

(65) Prior Publication Data

US 2012/0210957 A1 Aug. 23, 2012

(51) Int. Cl.
*F02B 75/22* (2006.01)

(52) U.S. Cl.
USPC ..... 123/54.4; 123/90.15; 123/48 R

(58) Field of Classification Search
USPC ..... 123/54.4, 48 C, 90.15, 575, 78 C, 78 R, 123/48 R
See application file for complete search history.

(56) References Cited

U.S. PATENT DOCUMENTS 5,443,043 A * 8/1995 Nilsson et al. ..... 123/48 C

FOREIGN PATENT DOCUMENTS

| | | | |
|---|---|---|---|
| JP | 2005-113743 | | 4/2005 |
| JP | 2005113743 A | * | 4/2005 |
| JP | 2005-256646 | | 9/2005 |
| JP | 2009-52455 | | 3/2009 |

OTHER PUBLICATIONS

International Search Report in International Application No. PCT/JP2009/069669; Mailing Date: Jan. 19, 2010.

* cited by examiner

*Primary Examiner* — Lindsay Low
*Assistant Examiner* — Omar Morales
(74) *Attorney, Agent, or Firm* — Finnegan, Henderson, Farabow, Garrett & Dunner, LLP

(57) ABSTRACT

The present variable compression ratio V-type internal combustion engine is a variable compression ratio V-type internal combustion engine which joins cylinder blocks of two cylinder groups and makes the joined cylinder block 10 move relatively to a crankcase along an arc-shaped path so as to move away from an engine crankshaft, wherein the arc-shaped path is set so that the mechanical compression ratio of one cylinder group and the mechanical compression ratio of the other cylinder group become equal when the cylinder block is at the lowest position closest to the engine crankshaft and when the cylinder block is at a specific position between the lowest position and a highest position which is furthest from the engine crankshaft.

5 Claims, 7 Drawing Sheets

VARIABLE COMPRESSION RATIO V-TYPE INTERNAL COMBUSTION ENGINE

CROSS-REFERENCE TO RELATED APPLICATIONS

This application is a national phase application of International Application No. PCT/JP2009/069669, filed Nov. 13, 2009, the contents of which are incorporated herein by reference.

TECHNICAL FIELD

The present invention relates to a variable compression ratio V-type internal combustion engine.

BACKGROUND ART

In general, the lower the engine load, the worse the heat efficiency, so at the time of engine low load operation, the mechanical compression ratio ((top dead center cylinder volume+stroke volume)/top dead center cylinder volume) is preferably raised to raise the expansion ratio and thereby improve the heat efficiency. For this, it has been known to make the cylinder block and crankcase move relative to each other to change the distance between the cylinder block and the crankshaft and thereby make the mechanical compression ratio variable.

In a V-type internal combustion engine, it has been proposed to make the cylinder block parts of the two cylinder groups move relatively to the crankcase separately along the cylinder centerlines of the cylinder groups, but it is difficult to make different cylinder block parts move relatively to the crankcase by a single link mechanism (or cam mechanism). A pair of link mechanisms (or cam mechanisms) becomes necessary for each cylinder block part, so overall two pairs of link mechanisms end up becoming necessary.

To reduce the number of link mechanisms, a variable compression ratio V-type internal combustion engine has been proposed which joins the cylinder blocks of two cylinder groups and makes the joined cylinder block move relatively to the crankcase by a pair of link mechanisms (refer to Japanese Unexamined Patent Publication No. 2005-113743).

DISCLOSURE OF THE INVENTION

In the above-mentioned variable compression ratio V-type internal combustion engine, when making the cylinder block move relatively to the crankcase, if the centerline of the cylinder block between the two cylinder groups in the front view accurately matches with the centerline of the engine passing through the center of the crankshaft, at each movement position of the cylinder block, the angle between the centerline of a connecting rod at top dead center and the centerline of the cylinders in one cylinder group becomes equal to the angle between the centerline of the connecting rod at top dead center and the centerline of the cylinders in the other cylinder group. It is therefore possible to make the mechanical compression ratio of one cylinder group and the mechanical compression ratio of the other cylinder group equal.

However, to make a cylinder block move relative to the crankcase, a simple link mechanism is sometimes used. In this case, the cylinder block moves along an arc-shaped path. In general, when the cylinder block is at the lowest position closest to the crankshaft and when it is at the highest position furthest from the crankshaft, in the front view, the cylinder block centerline between the two cylinder groups is made to match the engine centerline which passes through the center of the engine crankshaft. At these times, the mechanical compression ratio of one cylinder group and the mechanical compression ratio of the other cylinder group can be made equal. However, when the cylinder block is at a position other than these, in the front view, the cylinder block centerline between the two cylinder groups moves away from the engine centerline which passes through the center of the engine crankshaft in the same direction at all times. The mechanical compression ratio of one cylinder group and the mechanical compression ratio of the other cylinder group will therefore not become equal.

If a large difference in mechanical compression ratios occurs between the two cylinder groups in this way, it is difficult to eliminate the difference in output generated between the two cylinder groups, but if the difference in mechanical compression ratios between the two cylinder groups is small, it is possible to substantially eliminate the difference in output generated in the two cylinder groups by the ignition timing control or the like.

Therefore, an object of the present invention is to provide a variable compression ratio V-type internal combustion engine which joins the cylinder blocks of two cylinder groups and makes the joined block move relatively to the crankcase along an arc-shaped path so as to move away from the engine crankshaft wherein the difference in mechanical compression ratios between the two cylinder groups at the different positions of the cylinder blocks is prevented from becoming that great.

A variable compression ratio V-type internal combustion engine as set forth in claim 1 of the present invention is provided, characterized in that the variable compression ratio V-type internal combustion engine joins cylinder blocks of two cylinder groups and makes the joined cylinder block move relatively to a crankcase along an arc-shaped path so as to move away from an engine crankshaft, the arc-shaped path is set so that the mechanical compression ratio of one cylinder group and the mechanical compression ratio of the other cylinder group become equal when the joined cylinder block is at the lowest position closest to the engine crankshaft and when the joined cylinder block is at a specific position between the lowest position and a highest position which is furthest from the engine crankshaft.

A variable compression ratio V-type internal combustion engine as set forth in claim 2 of the present invention is provided as the variable compression ratio V-type internal combustion engine as set forth in claim 1 characterized in that the specific position is set so that mechanical compression ratios corresponding to different positions of the cylinder block from the lowest position to the specific position become suitable for different operations from minimum engine load operation to an engine load operation of about 70% of maximum engine load.

A variable compression ratio V-type internal combustion engine as set forth in claim 3 of the present invention is provided as the variable compression ratio V-type internal combustion engine as set forth in claim 1 characterized in that the specific position is set to a position about ⅔ from the lowest position of the arc-shaped path from the lowest position to the highest position.

A variable compression ratio V-type internal combustion engine as set forth in claim 4 of the present invention is provided as the variable compression ratio V-type internal combustion engine as set forth in any one of claims 1 to 3 characterized in that when the cylinder block is at the lowest position and when the cylinder block is at the specific position, in the front view, the center axial line of the cylinder block and the engine center axial line which passes through the center of the engine crankshaft match and the mechanical compression ratio of one cylinder group side and the mechanical compression ratio of the other cylinder group become equal and in that the center axial line of the cylinder block when the cylinder block is between the lowest position and the specific position and the center axial line of the cylinder block when the cylinder block is between the specific position and the highest position move away, in the front view, from the engine center axial line to opposite sides from each other.

A variable compression ratio V-type internal combustion engine as set forth in claim 5 of the present invention is provided as the variable compression ratio V-type internal combustion engine as set forth in any one of claims 1 to 3 characterized in that when the cylinder block is at the lowest position, in the front view, the center axial line of the cylinder block has a slant of an acute angle with respect to the engine center axial line which passes through the center of the engine crankshaft, a first acute angle between the cylinder center axial line of one cylinder group and the engine center axial line becomes smaller than a second acute angle between the cylinder center axial line of the other cylinder group and the engine center axial line, the mechanical compression ratio of one cylinder group and the mechanical compression ratio of the other cylinder group are made equal, when the cylinder block moves relatively with respect to the crankcase along the arc-shaped path, in the front view, the cylinder block is made to move in the engine center axial line direction and to move parallel in the other cylinder group side direction from the lowest position, and when the cylinder block is at the specific position, the mechanical compression ratio of one cylinder group side and the mechanical compression ratio of the other cylinder group become equal.

According to the variable compression ratio V-type internal combustion engine as set forth in claim 1 of the present invention, the variable compression ratio V-type internal combustion engine joins cylinder blocks of two cylinder groups and makes the joined cylinder block move relatively to a crankcase along an arc-shaped path so as to move away from an engine crankshaft, the arc-shaped path is set so that the mechanical compression ratio of one cylinder group and the mechanical compression ratio of the other cylinder group become equal when the joined cylinder block is at the lowest position closest to the engine crankshaft and when the joined cylinder block is at a specific position between the lowest position and a highest position which is furthest from the engine crankshaft. As opposed to this, in a general variable compression ratio V-type internal combustion engine, the arc-shaped path is set so that the mechanical compression ratio of one cylinder group and the mechanical compression ratio of the other cylinder group become equal when the cylinder block is at the lowest position and when the cylinder block is at the highest position. Due to this, other than times when the mechanical compression ratio of one cylinder group and the mechanical compression ratio of the other cylinder group become equal, the mechanical compression ratio of one cylinder group always becomes higher than the mechanical compression ratio of the other cylinder group, and the difference between the mechanical compression ratio of one cylinder group and the mechanical compression ratio of the other cylinder group sometimes becomes extremely large. However, according to the variable compression ratio V-type internal combustion engine as set forth in claim 1 according to the present invention, when the cylinder block is between the lowest position and the specific position, the mechanical compression ratio of one cylinder group becomes higher than the mechanical compression ratio of the other cylinder group, but when the cylinder block is between the specific position and the highest position, the mechanical compression ratio of the other cylinder group becomes higher than the mechanical compression ratio of one cylinder group, so the difference between the mechanical compression ratio of one cylinder group and the mechanical compression ratio of the other cylinder group at the different positions of the cylinder block can be prevented from becoming that large.

According to the variable compression ratio V-type internal combustion engine as set forth in claim 2 of the present invention, in the variable compression ratio V-type internal combustion engine as set forth in claim 1, the specific position is set so that mechanical compression ratios corresponding to different positions of the cylinder block from the lowest position to the specific position become suitable for different operations from minimum engine load operation to an engine load operation of about 70% of maximum engine load. Due to this, at the time of normal operation other than high load operation near maximum engine load, the cylinder block is positioned between the lowest position to close to the specific position so that a mechanical compression ratio suitable for each operation is realized, and the difference between the mechanical compression ratio of one cylinder group and the mechanical compression ratio of the other cylinder group never becomes that large.

According to the variable compression ratio V-type internal combustion engine as set forth in claim 3 of the present invention, in the variable compression ratio V-type internal combustion engine as set forth in claim 1, the specific position is set to a position about ⅔ from the lowest position of the arc-shaped path from the lowest position to the highest position. Due to this, in normal operation at the high mechanical compression ratio side where the cylinder block is positioned between the lowest position to close to the specific position, the difference between the mechanical compression ratio of one cylinder group and the mechanical compression ratio of the other cylinder group will never become that large.

According to the variable compression ratio V-type internal combustion engine as set forth in claim 4 of the present invention, in the variable compression ratio V-type internal combustion engine as set forth in any one of claims 1 to 3, when the cylinder block is at the lowest position and when the cylinder block is at the specific position, in the front view, the center axial line of the cylinder block and the engine center axial line which passes through the center of the engine crankshaft match and the mechanical compression ratio of one cylinder group and the mechanical compression ratio of the other cylinder group become equal and the center axial line of the cylinder block when the cylinder block is between the lowest position and the specific position and the center axial line of the cylinder block when the cylinder block is between the specific position and the highest position move away, in the front view, from the engine center axial line to opposite sides from each other. Due to this, when the cylinder block is between the lowest position and the specific position, the mechanical compression ratio of one cylinder group can become higher than the mechanical compression ratio of the other cylinder group, while when the cylinder block is between the specific position and the highest position, the mechanical compression ratio of the other cylinder group can become higher than the mechanical compression ratio of one cylinder group. Thus, the maximum distance separating the center axial line of the cylinder block and the engine center axial line becomes smaller, so it becomes possible to easily prevent the difference in mechanical compression ratios between the two cylinder groups from becoming that large at the different positions of the cylinder block.

According to the variable compression ratio V-type internal combustion engine as set forth in claim 5 of the present invention, in the variable compression ratio V-type internal combustion engine as set forth in any one of claims 1 to 3, when the cylinder block is at the lowest position, in the front view, the center axial line of the cylinder block has a slant of an acute angle with respect to the engine center axial line which passes through the center of the engine crankshaft, a first acute angle between the cylinder center axial line of one cylinder group and the engine center axial line becomes smaller than a second acute angle between the cylinder center axial line of the other cylinder group and the engine center axial line, the mechanical compression ratio of one cylinder group and the mechanical compression ratio of the other cylinder group are made equal, when the cylinder block moves relatively with respect to the crankcase along the arc-shaped path, in the front view, the cylinder block is made to move in the engine center axial line direction and to move parallel in the other cylinder group side direction from the lowest position, and when the cylinder block is at the specific position, the mechanical compression ratio of one cylinder group and the mechanical compression ratio of the other cylinder group become equal. Due to this, when the cylinder block is between the lowest position and the specific position, the mechanical compression ratio of one cylinder group can become higher than the mechanical compression ratio of the other cylinder group, while when the cylinder block is between the specific position and the highest position, the mechanical compression ratio of the other cylinder group can become higher than the mechanical compression ratio of one cylinder group. Thus, the maximum distance separating the center axial line of the cylinder block and the engine center axial line becomes smaller, so it becomes possible to easily prevent the difference in mechanical compression ratios between the two cylinder groups from becoming that large at the different positions of the cylinder block.

DESCRIPTION OF EMBODIMENTS

Figure 1:
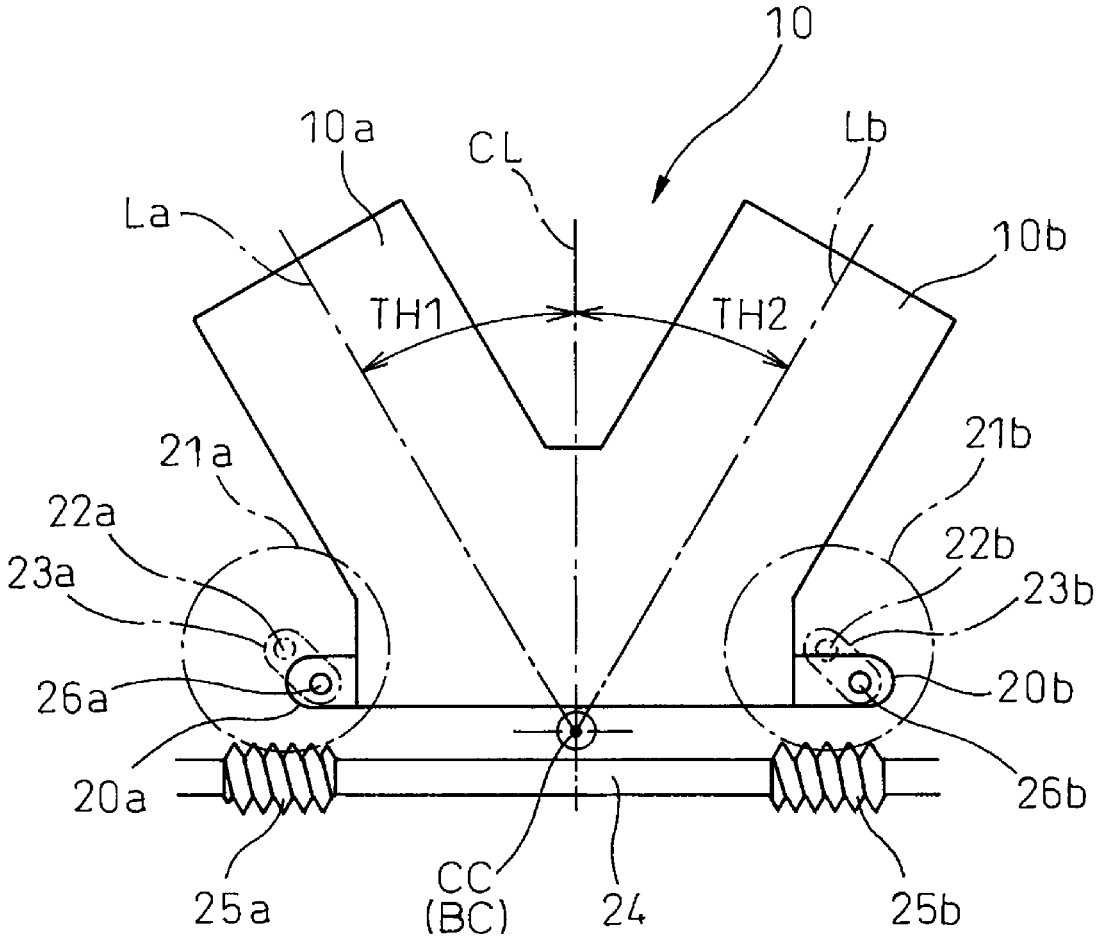
FIG. 1 is a schematic view which shows an embodiment of a variable compression ratio V-type internal combustion engine according to the present invention.

FIG. 1 is a schematic view which shows an embodiment of a variable compression ratio V-type internal combustion engine according to the present invention. In the figure, 10 indicates a cylinder block. The cylinder block 10 is comprised of a first cylinder group side part 10*a* and a second cylinder group side part 10*b* formed integrally.

This V-type internal combustion engine is a spark ignition type. The first cylinder group side part 10*a* and the second cylinder group side part 10*b* of the cylinder block 10 are mounted with cylinder heads. At each cylinder heads, spark plugs are provided for the cylinders. At each cylinder head, intake ports and exhaust ports are formed. Each intake port is communicated through an intake valve to a corresponding cylinder, while each exhaust port is communicated through an exhaust valve to a corresponding cylinder. For each cylinder head, an intake manifold and exhaust manifold are connected. The intake manifolds open to the atmosphere either independently of each other or with merging via an air cleaner, while the exhaust manifolds are also open to the atmosphere either independently of each other or with merging via a catalyst device. Further, the V-type internal combustion engine may be a diesel engine as well.

In general, the lower the engine load is, the worse the heat efficiency becomes, so at the time of engine low load operation, if raising the mechanical compression ratio to raise the expansion ratio, it is possible to improve the heat efficiency due to the work time of the pistons in the expansion stroke becoming longer. The mechanical compression ratio becomes the ratio (V1+V2)/V1 of the sum of the cylinder volume V1 at the top dead center crank angle and the stroke volume V2 with respect to the cylinder volume V1 at the top dead center crank angle and is equal to the expansion ratio of the expansion stroke. Due to this, the V-type internal combustion engine makes the cylinder block 10 move relatively to the crankcase (not shown) and changes the distance between the cylinder block 10 and the engine crankshaft (not shown) so as to make the mechanical compression ratios of the first cylinder group and the second cylinder group variable. For example, the mechanical compression ratios are controlled so that the lower the engine load, the higher the mechanical compression ratios are made. Further, if raising the mechanical compression ratios, knocking easily occurs, so it is also possible to raise the mechanical compression ratios at the time of engine low load operation when knocking is difficult to occur so as to be higher than that at the time of engine high load.

Next, a link mechanism for making the cylinder block move relatively to the crankcase will be explained. As shown in FIG. 1, the cylinder block 10 is provided with a first support 20*a* at the bottom part of the side surface of the first cylinder group side part 10*a* and with a second support 20*b* at the bottom part of the side surface of the second cylinder group side part 10*b*. The first support 20*a* is coupled through a first connecting shaft 26*a* to a first arm 23*a* which is fastened to a shaft 22*a* of a first gear 21*a*, while the second support 20*b* is coupled through a second connecting shaft 26*b* to a second arm 23*b* which is fastened to shaft 22*b* of a second gear 21*b*.

At a drive shaft 24 which extends in a horizontal direction perpendicular to the engine crankshaft, a first worm gear 25*a* and a second worm gear 25*b* are provided. The first gear 21*a* engages with the first worm gear 25*a*, while the second gear 21*b* engages with the second worm gear 25*b*.

Due to rotation of the drive shaft 24, the first worm gear 25*a* and second worm gear 25*b* respectively make the first gear 21*a* and the second gear 21*b* turn in the same direction (counterclockwise direction in FIG. 1). Due to this, through the shafts 22*a* and 22*b*, the first arm 23*a* and the second arm 23*b* are made to swing in the same direction. In this way, in the front view, the cylinder block 10 can be made to move in the horizontal direction (in FIG. 1, second cylinder group side direction) along the arc-shaped path of the first connecting shaft 26*a* and second connecting shaft 26*b* and can be made to move relatively to the crankcase in the vertical direction (engine center axial line CL direction passing through engine crankshaft center CC). By controlling the rotational times of the drive shaft 24 in this way, it is possible to move the cylinder block to the desired position.

Figure 2:
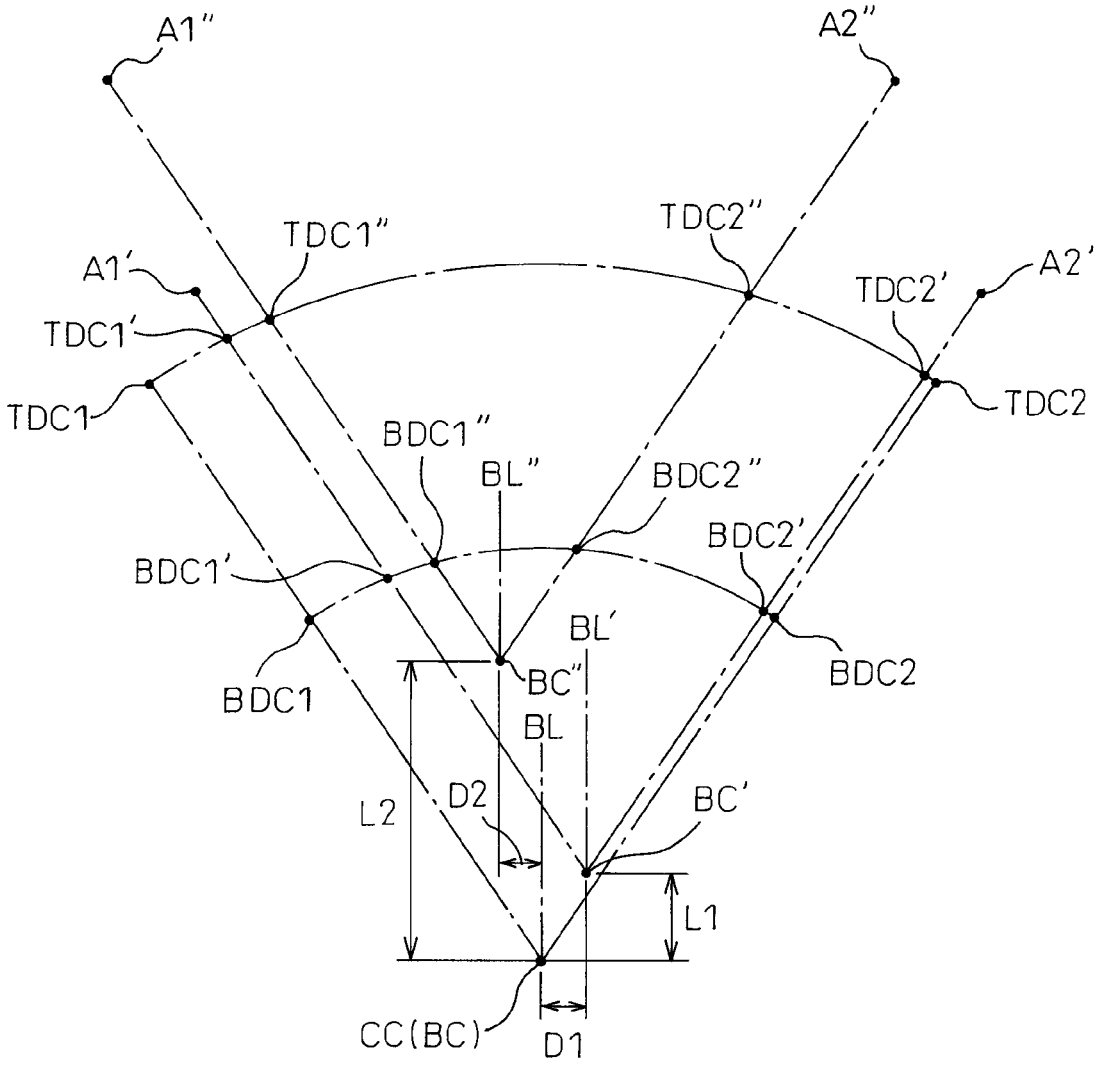
FIG. 2 is a view for explaining a change of the mechanical compression ratios in the variable compression ratio V-type internal combustion engine of FIG. 1.

FIG. 2 is a view for explaining changes in the mechanical compression ratios in the variable compression ratio V-type internal combustion engine of FIG. 1. In the figure, CC is the center of the engine crankshaft, TDC1 and BDC1 are the top dead center position and bottom dead center position of the piston pins of the cylinders of the first cylinder group at the lowest position of the cylinder block nearest to the engine crankshaft, and TDC2 and BDC2 are the top dead center position and bottom dead center position of the piston pins of the cylinders of the second cylinder group at the lowest position of the cylinder block. In the present embodiment, the front view intersecting point BC of the cylinder centerline of the first cylinder group and the cylinder centerline of the second cylinder group matches the engine crankshaft center CC at the lowest position of the cylinder block.

Further, at the lowest position of the cylinder block, the center axial line of the cylinder block which passes through the front view intersecting point BC and the engine center axial line CL which passes through the center CC of the engine crankshaft match. As shown in FIG. 1, in the front view, the first acute angle TH1 between the cylinder center axial line La of the first cylinder group and the engine center axial line CL and the second acute angle TH2 between the cylinder center axial line Lb of the second cylinder group and the engine center axial line CL become equal.

The relative movement mechanism of FIG. 1 is used so that the cylinder block moves on an arc-shaped path, so if making the cylinder block move in the top direction (engine center axial line direction) by exactly the distance L1, the cylinder block simultaneously is made to move in parallel in the second cylinder group side direction by exactly the distance D1. Due to this, the center axial line BL of the cylinder block which matched with the engine center axial line CL at the lowest position of the cylinder block moves away from the engine center axial line CL to the second cylinder group side direction by exactly the distance D1 to become positioned as shown by BL'. Further, the front view intersecting point BC becomes the position which is shown by BC', the top dead center position and bottom dead center position of the piston pins of the cylinders of the first cylinder group respectively become TDC1' and BDC1', and the top dead center position and bottom dead center position of the piston pins of the cylinders of the second cylinder group respectively become TDC2' and BDC2'. A1' is the imaginary top dead center position of the piston pins of the cylinders of the first cylinder group when the engine crankshaft also moves together with the cylinder block, while A2' is the imaginary top dead center position of the piston pins of the cylinders of the second cylinder group when the engine crankshaft also moves together with the cylinder block.

In this way, due to movement of the cylinder block in the top direction, at the first cylinder group and second cylinder group, the positions of the piston pins at top dead center descend from A1' and A2' to TDC1' and TDC2', so the cylinder volumes at the top dead center crank angle become larger. On the other hand, the stroke volumes (between TDC1 and BDC1, between TDC2 and BDC2, between TDC1' and BDC1', and between TDC2' and BDC2') do not change much at all (strictly speaking, slightly change), so the mechanical compression ratios become smaller. Further, due to the parallel movement of the cylinder block in the second cylinder group direction, as shown in FIG. 2, the piston pin position at top dead center at the second cylinder group is further lower than the piston pin position of top dead center at the first cylinder group, and the mechanical compression ratio of the second cylinder group becomes smaller than the mechanical compression ratio of the first cylinder group.

Figure 3:
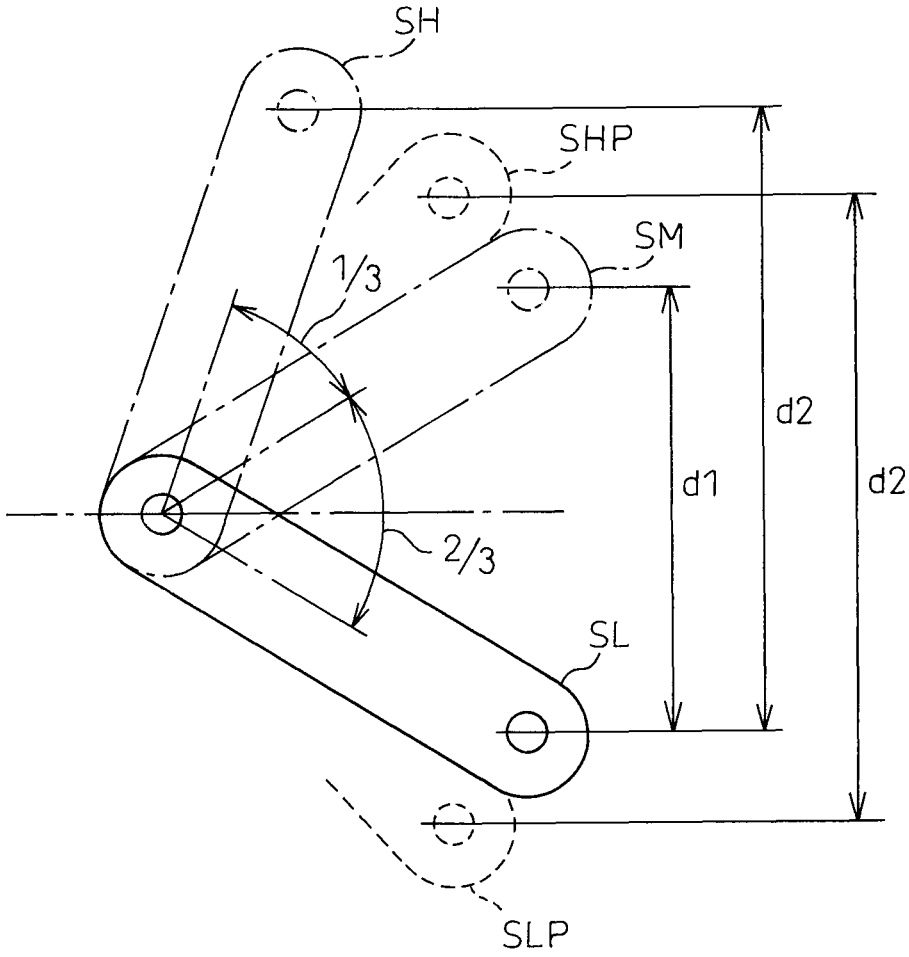
FIG. 3 is a view for explaining a link mechanism which makes the cylinder block of the variable compression ratio V-type internal combustion engine of FIG. 1 move.

FIG. 3 shows the operation of the first arm 23*a* (or the second arm 23*b*) of the link mechanism of FIG. 1. The position which is shown by the solid line is a first swing position SL of the first arm 23*a* corresponding to the lowest position of the cylinder block. As explained above, at this lowest position of the cylinder block (zero amount of displacement of engine center axial line CL direction), in the front view, the center axial line BL of the cylinder block and the engine center axial line CL match. Further, a second swing position SH of the first arm 23*a* which is shown by the one-dot chain line corresponds to the highest position of the cylinder block (amount of displacement d2 of engine center axial line CL direction).

While the cylinder block is being made to move from the lowest position to the highest position, until the first arm 23*a* becomes the horizontal position perpendicularly intersecting the engine center axial line CL, the center axial line BL of the cylinder block moves in parallel so as to gradually move away from the engine center axial line CL in the horizontal direction (in the present embodiment, second cylinder group side direction). When the first arm 23*a* reaches the horizontal position, the center axial line BL of the cylinder block moves away the most from the engine center axial line CL in the horizontal direction.

Furthermore, if making the first arm 23*a* swing, the center axial line BL of the cylinder block moves in parallel in the horizontal direction to gradually approach the engine center axial line CL. When the first arm 23*a* reaches a third swing position SM symmetric across the horizontal axial line with the first swing position SL of the first arm 23*a* corresponding to the lowest position of the cylinder block, the center axial line BL of the cylinder block matches the engine center axial line CL. The third swing position SM of the first arm 23*a* corresponds to the specific position of the cylinder block (amount of displacement d1 in engine center axial line CL direction). If the first arm 23*a* is made to further swing, the center axial line BL of the cylinder block moves in parallel so as to gradually move away from the engine center axial line CL in the horizontal reverse direction (in the present embodiment, first cylinder group side direction).

In this way, in FIG. 2, if the cylinder block is made to move in the top direction (engine center axial line direction) by exactly the distance L2, the cylinder block is simultaneously made to move in parallel in the first cylinder group side direction by exactly the distance D2. Due to this, the center axial line BL of the cylinder block which had matched the engine center axial line CL at the specific position of the cylinder block moves away from the engine center axial line CL in the first cylinder group side direction by exactly the distance D2 and reaches the position which is shown by BL". Further, the front view intersecting point BC becomes the position which is shown by BC", the top dead center position and bottom dead center position of the piston pins of the cylinders of the first cylinder group respectively become TDC1" and BDC1", and the top dead center position and bottom dead center position of the piston pins of the cylinders of the second cylinder group respectively become TDC2" and BDC2". A1" is the imaginary top dead center position of the piston pins of the cylinders of the first cylinder group in the case where the engine crankshaft also moves together with the cylinder block, while A2" is the imaginary top dead center position of the piston pins of the cylinders of the second cylinder group in the case where the engine crankshaft also moves together with the cylinder block.

In this way, the positions of the piston pins at top dead center descend from A1" and A2" to respectively TDC1" and TDC2", so the cylinder volumes at the top dead center crank angle become larger. On the other hand, the stroke volumes (between TDC1 and BDC1, between TDC2 and BDC2, between TDC1" and BDC1", and between TDC2" and BDC2") do not change that much (strictly speaking, slightly change), so the mechanical compression ratios becomes smaller. Further, due to the parallel movement of the cylinder block in the first cylinder group direction, as shown in FIG. 2, the piston pin position at top dead center in the first cylinder group descends further from the piston pin position at top dead center in the second cylinder group and the mechanical compression ratio of the first cylinder group becomes smaller than the mechanical compression ratio of the second cylinder group.

Figure 4:
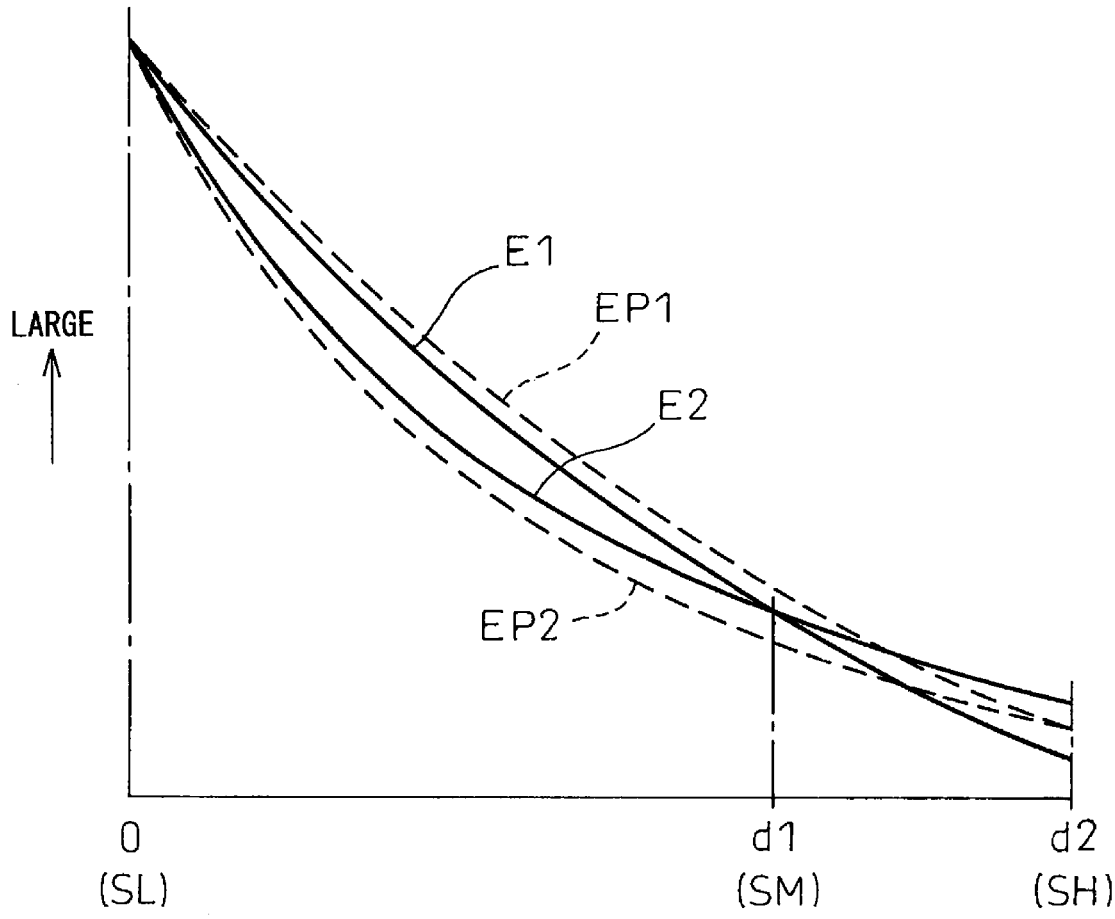
FIG. 4 is graphs which show changes in the mechanical compression ratios with respect to amounts of displacement of the cylinder block.

FIG. 4 is a graph which shows the changes in the mechanical compression ratios with respect the amount of displacement "d" of the cylinder block in the engine center axial line direction (vertical direction). The solid lines E1 and E2 show the mechanical compression ratios of the first cylinder group and second cylinder group in the case of using the link mechanism of the present embodiment which is explained in FIG. 3 to make the cylinder block move.

As explained above, when the center axial line BL of the cylinder block moves away from the engine center axial line CL to the second cylinder group side, the mechanical compression ratio of the first cylinder group becomes larger than the mechanical compression ratio of the second cylinder group, while when the center axial line BL of the cylinder block moves away from the engine center axial line CL to the first cylinder group side, the mechanical compression ratio of the first cylinder group becomes smaller than the mechanical compression ratio of the second cylinder group. Further, when the center axial line BL of the cylinder block matches the engine center axial line CL, the mechanical compression ratio of the first cylinder group and the mechanical compression ratio of the second cylinder group become equal.

Due to this, in the present embodiment, at the lowest position (d=0) and the specific position (d=d1) of the cylinder block, the mechanical compression ratio of the first cylinder group and the mechanical compression ratio of the second cylinder group become equal.

As opposed to this, in a general variable compression ratio V-type internal combustion engine, as shown in FIG. 3 by the broken line, the swing position SLP of the first arm 23*a* corresponding to the lowest position of the cylinder block (d=0) and the swing position SHP of the first arm 23*a* corresponding to the highest position of the cylinder block (d=d2) are symmetric about the horizontal axial line. At these swing positions SLP and SHP, the center axial line BL of the cylinder block and the engine center axial line CL are made to match.

In FIG. 4, the broken lines EP1 and EP2 show the mechanical compression ratios of the first cylinder group and second cylinder group of the general variable compression ratio V-type internal combustion engine. At the lowest position (d=0) and highest position (d=d2) of the cylinder block, the mechanical compression ratio of the first cylinder group and the mechanical compression ratio of the second cylinder group become equal.

Figure 5:
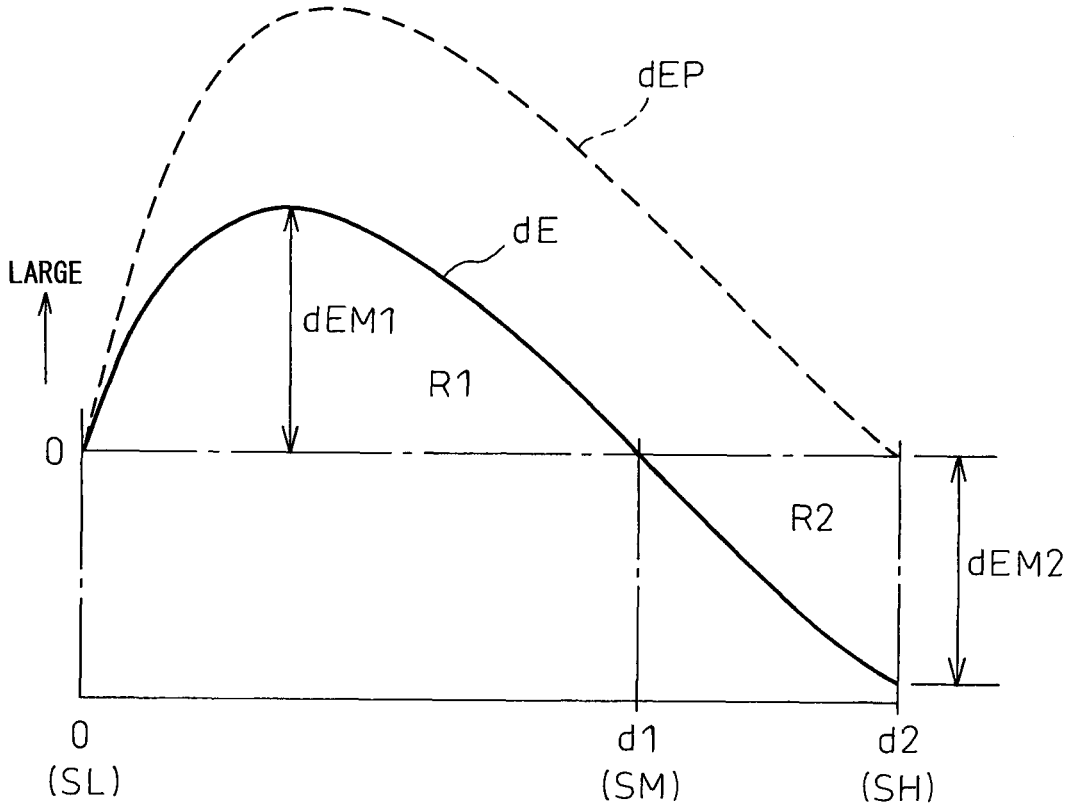
FIG. 5 is graphs which show changes in deviation of the mechanical compression ratios between two cylinder groups with respect to amounts of displacement of the cylinder block.

FIG. 5 is a graph which shows the changes in deviation between the mechanical compression ratio of the first cylinder group and the mechanical compression ratio of the second cylinder group with respect to the amount of displacement "d" of the cylinder block in the engine center axial line direction (vertical direction). The solid line dE shows the case of the present embodiment, while the broken line dEP shows the case of the general variable compression ratio V-type internal combustion engine. As shown in FIG. 5, the further apart the center axial line BL of the cylinder block and the engine center axial line CL, the greater the difference (absolute value of deviation) between the mechanical compression ratio of the first cylinder group and the mechanical compression ratio of the second cylinder group. By making, like in the present embodiment, the position where the center axial line BL of the cylinder block and the engine center axial line CL match, a specific position at the lowest position side from the highest position of the cylinder block, it is possible to reduce the maximum separation distance between the center axial line BL of the cylinder block and the engine center axial line CL and possible to prevent the difference in mechanical compression ratios between the first cylinder group and the second cylinder group at the different positions of the cylinder block from becoming that large compared with a general variable compression ratio V-type internal combustion engine.

Figure 6:
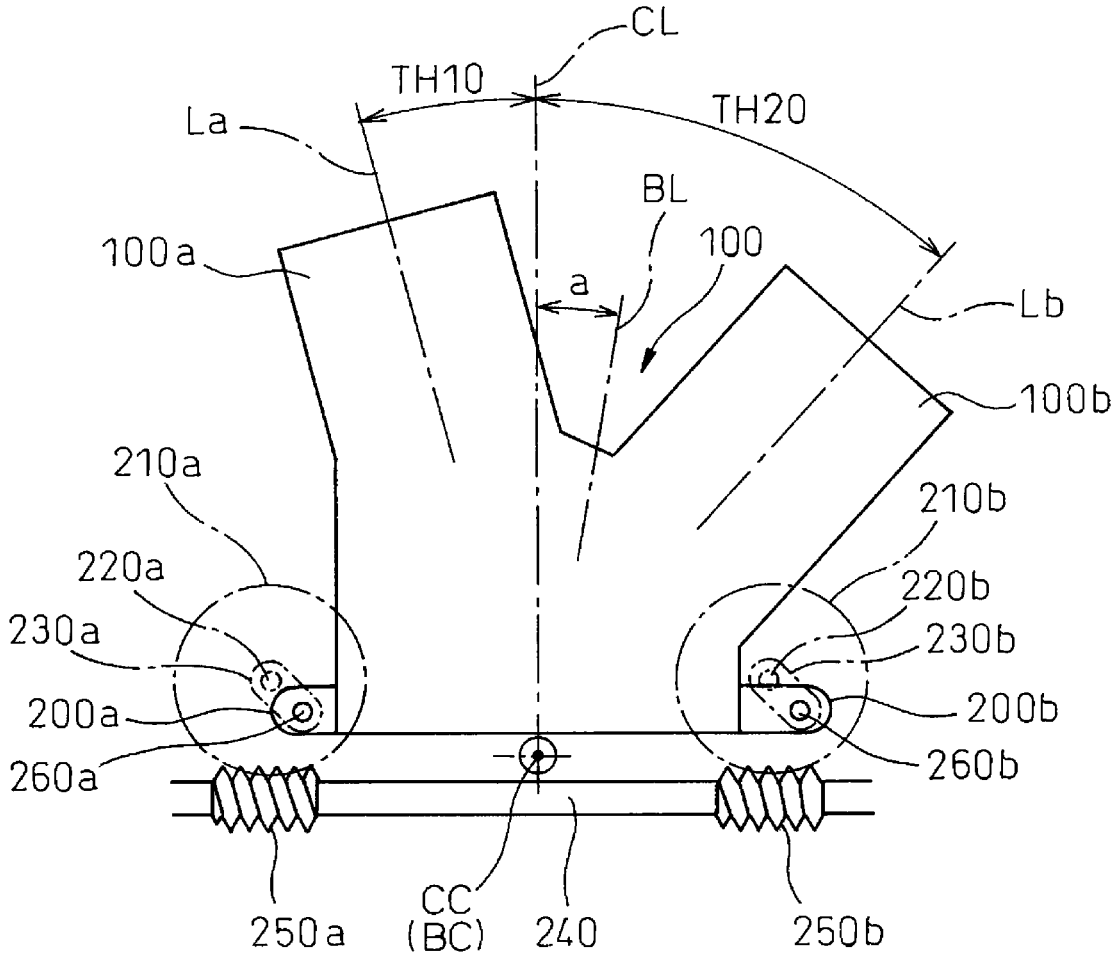
FIG. 6 is a schematic view which shows another embodiment of a variable compression ratio V-type internal combustion engine according to the present invention.

FIG. 6 is a schematic view which shows another embodiment of a variable compression ratio V-type internal combustion engine according to the present invention. Only the differences from the embodiment of FIG. 1 will be explained below. In FIG. 6, 100 is a cylinder block. The cylinder block 100 is comprised of a first cylinder group side part 100*a* and a second cylinder group side part 100*b* formed integrally.

The cylinder block 100 is provided with a first support 200*a* at the bottom part of the side surface of the first cylinder group side part 100*a* and with a second support 200*b* at the bottom part of the side surface of the second cylinder group side part 100*b*. The first support 200*a* is coupled through a first connecting shaft 260*a* to a first arm 230*a* which is fastened to a shaft 220*a* of a first gear 210*a*, while the second support 200*b* is coupled with a second connecting shaft 260*b* to a second arm 230*b* which is fastened to a shaft 220*b* of a second gear 210*b*. The drive shaft 240 is provided with a first worm gear 250*a* and a second worm gear 250*b*. The first worm gear 250*a* engages with the first gear 210*a*, while the second worm gear 250*b* engages with the second gear 210*b*.

Due to rotation of the drive shaft 240, the first worm gear 250*a* and second worm gear 250*b* respectively make the first gear 210*a* and the second gear 210*b* turn in the same direction (in FIG. 1, counterclockwise direction). Due to this, through the shafts 220*a* and 220*b*, the first arm 230*a* and the second arm 230*b* are made to swing in the same direction. In this way, in the front view, it is possible to make the cylinder block 100 move along the arc-shaped path of the first connecting shaft 260*a* and second connecting shaft 260*b* in the horizontal direction (in FIG. 1, the second cylinder group side direction) while making it move in the vertical direction (engine center axial line CL direction passing through engine crankshaft center CC) relatively to the crankcase.

Figure 7:
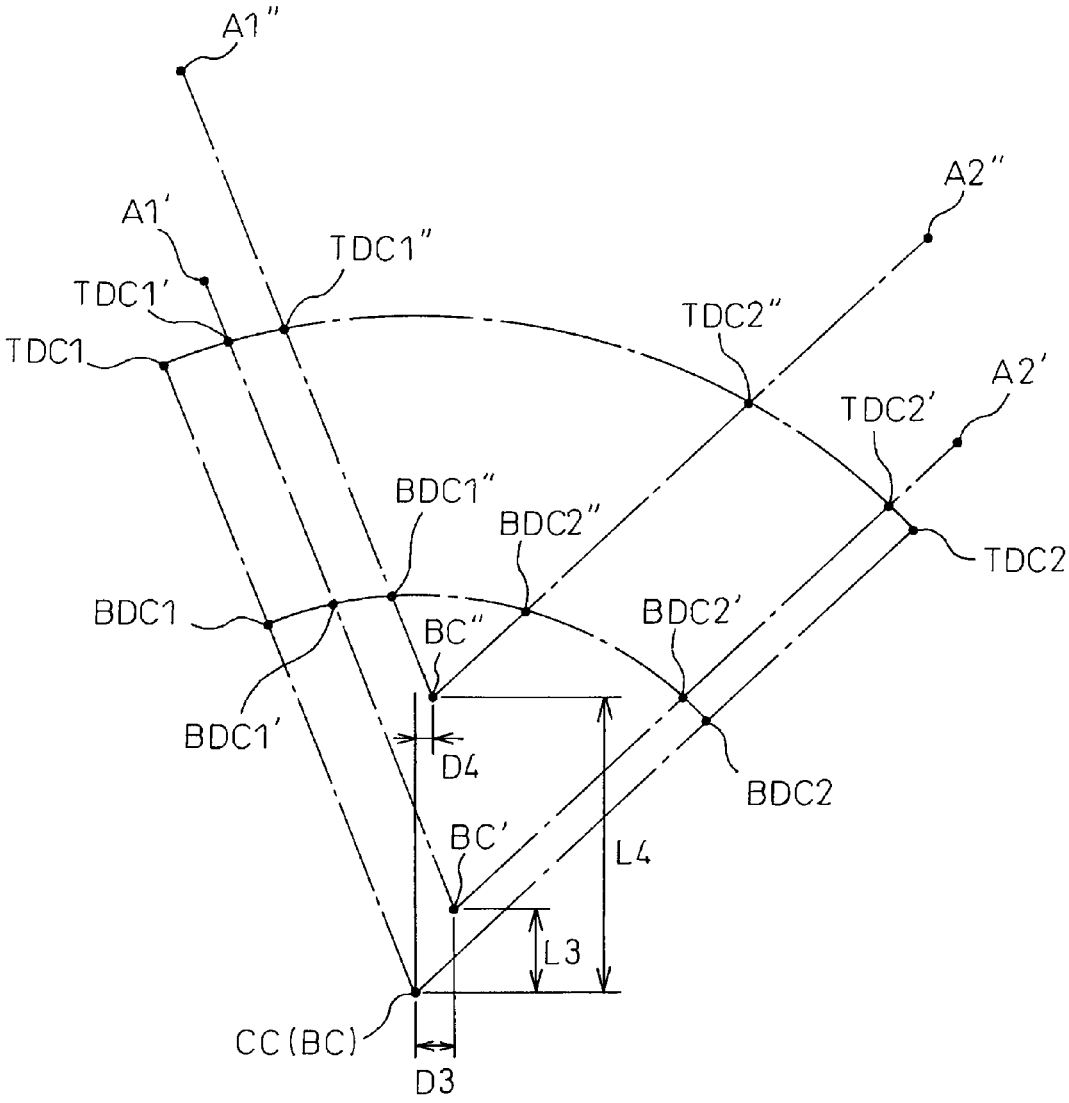
FIG. 7 is a view for explaining changes in the mechanical compression ratios in the variable compression ratio V-type internal combustion engine of FIG. 6.

FIG. 7 is a view for explaining the changes in the mechanical compression ratios in the variable compression ratio V-type internal combustion engine of FIG. 6. In the present embodiment, the front view intersecting point BC between the cylinder centerline of the first cylinder group and the cylinder centerline of the second cylinder group matches the engine crankshaft center CC at the lowest position of the cylinder block. Further, as shown in FIG. 6, in the front view, at the lowest position of the cylinder block, an acute angle "a" is formed between the center axial line BL of the cylinder block which passes through the front view intersecting point BC and the engine center axial line CL which passes through the center CC of the engine crankshaft. The first acute angle TH10 between the cylinder center axial line La of the first cylinder group and the engine center axial line CL becomes smaller than the second acute angle TH20 between the cylinder center axial line Lb of the second cylinder group and the engine center axial line CL.

The operation of the link mechanism of FIG. 6 is a general one. For example, in FIG. 3, the swing position of the first arm 230*a* (or second arm 230*b*) corresponding to the lowest position of the cylinder block (zero amount of displacement in engine center axial line CL direction) is SLP which is shown by the broken lines, while the swing position of the first arm 230*a* (or second arm 230*b*) corresponding to the highest position of the cylinder block (amount of displacement d2 in engine center axial line CL direction) is SHP which is shown by the broken lines. The swing position SLP of the first arm 230*a* and the swing position SHP of the first arm 230*a* are symmetric with each other about the horizontal axial line. At the lowest position of the cylinder block, the mechanical compression ratio of the first cylinder group and the mechanical compression ratio of the second cylinder group are made equal.

As shown in FIG. 7, when the cylinder block moves along such an arc-shaped path, the acute angle "a" between the center axial line BL of the cylinder block and the engine center axial line CL is constantly maintained. If making the cylinder block move in the top direction (engine center axial line direction) by exactly the distance L3, the cylinder block simultaneously is made to move in parallel in the second cylinder group side direction by exactly the distance D3 from on the lowest position. Due to this, the front view intersecting point BC becomes the position which is shown by BC', the top dead center position and bottom dead center position of the piston pins of the cylinders of the first cylinder group respectively become TDC1' and BDC1', and the top dead center position and bottom dead center position of the piston pins of the cylinders of the second cylinder group respectively become TDC2' and BDC2'. A1' is the imaginary top dead center position of the piston pins of the cylinders of the first cylinder group in the case where the engine crankshaft also moves together with the cylinder block, while A2' is the imaginary top dead center position of the piston pins of the cylinders of the second cylinder group in the case where the engine crankshaft also moves together with the cylinder block.

Due to such initial movement of the cylinder block, at the first cylinder group and second cylinder group, the positions of the piston pins at top dead center fall from A1' and A2' to respectively TDC1' and TDC2', so the cylinder volumes at top dead center crank angle become larger, while the stroke volumes (between TDC1 and BDC1, between TDC2 and BDC2, between TDC1' and BDC1', and between TDC2' and BDC2') do not change that much (strictly speaking, slightly change), so the mechanical compression ratios become smaller.

As in the present embodiment, when, in the front view, at the lowest position of the cylinder block, an acute angle "a" is formed between the center axial line BL of the cylinder block which passes through the front view intersecting point BC and the engine center axial line CL which passes through the center CC of the engine crankshaft, and a first acute angle TH10 between the cylinder center axial line La of the first cylinder group and the engine center axial line CL is smaller than a second acute angle TH20 between the cylinder center axial line Lb of the second cylinder group and engine center axial line CL, due to parallel movement of the cylinder block in the second cylinder group direction, the piston pin position at top dead center in the second cylinder group tends to fall further than the piston pin position at top dead center in the first cylinder group. On the other hand, due to movement of the cylinder block in the engine center axial line direction, the piston pin position at top dead center in the first cylinder group tends to fall further than the piston pin position at top dead center in the second cylinder group.

If, due to further movement of the cylinder block, the cylinder block is made to move in the top direction (engine center axial line direction) by exactly the distance L4, the cylinder block is simultaneously made to move in parallel in the second cylinder group side direction by exactly the distance D4 from the lowest position. Due to this, the front view intersecting point BC becomes the position which is shown by BC", the top dead center position and bottom dead center position of the piston pins of the cylinders of the first cylinder group respectively become TDC1" and BDC1", and the top dead center position and bottom dead center position of the piston pins of the cylinders of the second cylinder group respectively become TDC2" and BDC2". A1" is the imaginary top dead center position of the piston pins of the cylinders of the first cylinder group in the case where the engine crankshaft also moves together with the cylinder block, while A2" is the imaginary top dead center position of the piston pins of the cylinders of the second cylinder group in the case where the engine crankshaft also moves together with the cylinder block.

In this way, the positions of the piston pins at top dead center fall from A1" and A2" to respectively TDC1" and TDC2", so the cylinder volumes at the top dead center crank angle become large, while the stroke volumes (between TDC1 and BDC1, between TDC2 and BDC2, between TDC1" and BDC1", and between TDC2" and BDC2") do not change much at all (strictly speaking, slightly change), so the mechanical compression ratios become smaller. If, in this way, the amount of movement of the cylinder block in the top direction becomes larger and the amount of movement to the second cylinder group side becomes smaller, the piston pin position at top dead center in the first cylinder group falls further from the piston pin position at top dead center in the second cylinder group and the mechanical compression ratio of the first cylinder group becomes smaller than the mechanical compression ratio of the second cylinder group.

In this way, in the embodiment of FIG. 6 as well, the deviation between the mechanical compression ratio of the first cylinder group and the mechanical compression ratio of the second cylinder group with respect to the amount of displacement "d" of the cylinder block in the engine center axial line direction (vertical direction) changes as shown by dE of FIG. 5. Similar advantageous effects can be obtained as with the embodiment of FIG. 1.

In this regard, in the case of controlling the mechanical compression ratios to become smaller the higher the engine load, the engine load at the time of normal operation is about 70% or less of the maximum engine load, so if setting things so that the desired engine compression ratio at the time of an engine load of about 70% of the maximum engine load is realized at the specific position of the cylinder block (the position of the amount of displacement d1 of the cylinder block where the mechanical compression ratio of the first cylinder group and the mechanical compression ratio of the second cylinder group become equal), at the time of normal operation other than the high load operation which occurs only infrequently, the position of the cylinder block is mainly controlled between the lowest position and the specific position and the difference between the mechanical compression ratio of the first cylinder group and the mechanical compression ratio of the second cylinder group can be made relatively small.

Further, even if the specific position of the cylinder block is set to a position of about ⅔ from the lowest position of the arc-shaped path from the lowest position to the highest position (FIG. 3 shows the case of the embodiment of FIG. 1), in normal operation at the high mechanical compression ratio side where the cylinder block is positioned between the lowest position to close to the specific position, the difference between the mechanical compression ratio of the first cylinder group and the mechanical compression ratio of the second cylinder group can be made relatively small. Further, the specific position of the cylinder block may be made a position of about ⅔ of the distance of movement in the engine center axial line direction.

Further, the specific position of the cylinder block may be set so that the total of the difference between the mechanical compression ratio of the first cylinder group and the mechanical compression ratio of the second cylinder group at the different positions of the cylinder block becomes the minimum. That is, in FIG. 5, the specific position of the cylinder block (amount of displacement d1) is set so that the total area of the area R1 and area R2 (positive value) which are surrounded by the curve dE and the line dE=0 becomes the minimum. Due to this, in normal operation at the high mechanical compression ratio side where the cylinder block is positioned between the lowest position to near the specific position, the difference between the mechanical compression ratio of the first cylinder group and the mechanical compression ratio of the second cylinder group can be made relatively small. Further, even at the different positions of the cylinder block, the difference between the mechanical compression ratio of the first cylinder group and the mechanical compression ratio of the second cylinder group can be made small.

Further, as shown in FIG. 5, it is also possible to set the specific position of the cylinder block (amount of displacement d1) so that the maximum value dEM1 of the difference between the mechanical compression ratio of the first cylinder group and the mechanical compression ratio of the second cylinder group from the lowest position (d=0) to the specific position of the cylinder block and the maximum value dEM2 of the difference between the mechanical compression ratio of the first cylinder group and the mechanical compression ratio of the second cylinder group from the specific position to the highest position (d=d2) of the cylinder block become equal. Due to this, at the time of normal operation at the high mechanical compression ratio side where the cylinder block is positioned between the lowest position to close to the specific position, the difference between the mechanical compression ratio of the first cylinder group and the mechanical compression ratio of the second cylinder group can be made relatively small. Further, at all positions of the cylinder block, the difference between the mechanical compression ratio of the first cylinder group and the mechanical compression ratio of the second cylinder group can be made smaller.

LIST OF REFERENCE NUMERALS

10, 100: cylinder block
10*a*, 100*a*: first cylinder group side part
10*b*, 100*b*: second cylinder group side part
BL: center axial line of cylinder block
CL: engine center axial line

The invention claimed is:

1. A variable compression ratio V-type internal combustion engine which joins cylinder blocks of two cylinder groups and is configured to move the joined cylinder block relative to a crankcase along an arc-shaped path so as to move the joined cylinder block away from an engine crankshaft, wherein said arc-shaped path is set such that at the lowest position of the joined cylinder block closest to said engine crankshaft and at a specific position of the joined cylinder block between said lowest position and a highest position which is furthest from said engine crankshaft, the mechanical compression ratio of both cylinder groups becomes equal.

2. A variable compression ratio V-type internal combustion engine as set forth in claim 1 wherein said specific position is set so that mechanical compression ratios corresponding to different positions of said joined cylinder block from said lowest position to said specific position become suitable for different operations from minimum engine load operation to an engine load operation of about 70% of maximum engine load.

3. A variable compression ratio V-type internal combustion engine as set forth in claim 1 wherein said specific position is set to a position about ⅔ from said lowest position of said arc-shaped path from said lowest position to said highest position.

4. A variable compression ratio V-type internal combustion engine as set forth in claim 1, wherein at the lowest position of the joined cylinder block and at the specific position of the joined cylinder block, in the front view, the center axial line of said joined cylinder block and the engine center axial line which passes through the center of said engine crankshaft match and the mechanical compression ratio of one cylinder group and the mechanical compression ratio of the other cylinder group becomes equal and wherein the center axial line of said joined cylinder block at a position between said lowest position and said specific position of said joined cylinder block and the center axial line of said joined cylinder block at a position between said specific position and said highest position move away, in the front view, from said engine center axial line to opposite sides from each other.

5. A variable compression ratio V-type internal combustion engine as set forth in claim 1, wherein at the lowest position of said joined cylinder block, in the front view, the center axial line of said joined cylinder block has a slant of an acute angle with respect to the engine center axial line which passes through the center of said engine crankshaft, a first acute angle between the cylinder center axial line of one cylinder group and said engine center axial line is smaller than a second acute angle between the cylinder center axial line of the other cylinder group and said engine center axial line, the mechanical compression ratio of one cylinder group and the mechanical compression ratio of the other cylinder group are made equal, and as said joined cylinder block is moved relatively with respect to said crankcase along said arc-shaped path, in the front view, said joined cylinder block is moved in said engine center axial line direction and is moved parallel in said other cylinder group side direction from said lowest position, and at said specific position of said joined cylinder block, the mechanical compression ratio of one cylinder group and the mechanical compression ratio of the other cylinder group become equal.

* * * * *